US008857407B2

(12) United States Patent
Furuya

(10) Patent No.: US 8,857,407 B2
(45) Date of Patent: Oct. 14, 2014

(54) OPERATION DEVICE FOR ENGINE

(75) Inventor: Akira Furuya, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/591,650

(22) Filed: Aug. 22, 2012

(65) Prior Publication Data

US 2013/0068196 A1 Mar. 21, 2013

(30) Foreign Application Priority Data

Sep. 20, 2011 (JP) ..... 2011-204359

(51) Int. Cl.
*F02B 33/00* (2006.01)
*F02D 11/04* (2006.01)
*F02D 9/10* (2006.01)

(52) U.S. Cl.
CPC ..... *F02D 9/1065* (2013.01); *F02D 11/04* (2013.01)
USPC ..... 123/330; 123/400

(58) Field of Classification Search
CPC ..... F02M 1/00; F02M 1/02; F02M 11/02; Y02T 10/146; F02D 11/04; F02D 9/02
USPC ..... 123/330, 337, 342, 376, 400, 402; 261/23.2, 38, 39.2, 42, 43
See application file for complete search history.

(56) References Cited

U.S. PATENT DOCUMENTS

| | | | | | |
|---|---|---|---|---|---|
| 4,392,502 | A * | 7/1983 | Weston | ..... | 123/342 |
| RE34,138 | E * | 12/1992 | Flaig et al. | ..... | 123/400 |
| 5,699,768 | A * | 12/1997 | Saito et al. | ..... | 123/400 |
| 7,343,896 | B2 * | 3/2008 | Grant et al. | ..... | 123/336 |
| 8,511,650 | B2 | 8/2013 | Kern et al. | | |
| 2012/0161341 | A1 * | 6/2012 | Arai | ..... | 261/39.1 |

FOREIGN PATENT DOCUMENTS

| | | |
|---|---|---|
| DE | 10 2010 009 915 | 9/2010 |
| JP | 61-125648 | 8/1986 |

* cited by examiner

*Primary Examiner* — Mahmoud Gimie
*Assistant Examiner* — Sizo Vilakazi
(74) *Attorney, Agent, or Firm* — Smith, Gambrell & Russell, LLP

(57) ABSTRACT

There is the operation device for an engine. An operation device for an engine performs a throttle operation of the engine which is disposed apart from an operation unit operated by an operator. The operation device includes: a link member rotatable with respect to a base in response to an operation of the operation unit; a cam member fixed to the base, and disposed at a distance from the center of rotation of the link member, the distance changing continuously according to the angular position of the cam member around the center of rotation; a cam follower connected to the link member and configured to along the cam member; and a throttle drive member for connecting the cam follower to a throttle operation unit of the engine.

19 Claims, 9 Drawing Sheets

OPERATION DEVICE FOR ENGINE

CROSS-REFERENCE TO RELATED APPLICATIONS

The present application claims priority from Japanese Patent Application No. 2011-204359 filed on Sep. 20, 2011, the entire contents of which are hereby incorporated by reference.

BACKGROUND OF THE INVENTION

1. Field of the Invention

The present invention relates to an operation device for an engine which performs a throttle operation of an engine where the operation device is disposed apart from an operation unit, and particularly relates to an operation device which increases the degree of freedom in setting the relationship between an operation amount of the operation unit and a throttle opening with a simple structure.

2. Description of the Related Art

For example, in an engine-driven mowing machine or the like, an operation unit such as a lever to be operated by an operator during a machine operation may be disposed apart from the engine body. In such a case, it is demanded that an operation device have a configuration in which turning on and off of the engine, a throttle operation, a choke operation, and the like can be remotely controlled by an operator using a single operating member at hand.

As the conventional art related to such an operation device for an engine, for example, Japanese Unexamined Utility Model Application Publication No. S61-125648 discloses a manipulation device for an internal combustion engine, which performs a throttle operation and a choke operation for an engine using a single cable for remote control, and controls a throttle opening for a high speed operation with a stopper.

SUMMARY OF THE INVENTION

However, in the above-described conventional art, even though the maximum number of revolutions is controlled by the stopper, the number of revolutions of the engine is further increased due to an increase in fuel consumption when the choke is in operation. In order to avoid such an undesired increase in the number of revolutions, an additional mechanism which closes the throttle during an operation period of the choke is needed. According to the above approach, a configuration may be made such that the throttle is closed when the choke is in operation, for example, by using a link mechanism or the like. However, in this case, the structure becomes complicated, the number of the parts increases, and the size, weight, and cost of product also increase. It is an object of the present invention to provide an operation device which increases the degree of freedom in setting the relationship between an operation amount of an operation unit and a throttle opening with a simple structure.

The present invention has been made in view of the above-described problems. A first aspect of the invention provides an operation device for an engine which performs a throttle operation of the engine which is disposed apart from an operation unit which is operated by an operator, the operation device including: a link member which is rotatable with respect to a base in response to an operation of the operation unit; a cam member which is fixed to the base, and has a distance from a center of rotation of the link member, the distance changing continuously according to an angular position of the cam member around the center of rotation; a cam follower which is connected to the link member, and configured to move along the cam member; and a throttle drive member configured to connect the cam follower to a throttle operation unit of the engine. According to the above, a simple structure may be adopted in which each member is rotated around a single shaft, and the relationship between an operation amount of the operation unit and a throttle opening can be arbitrarily established by defining the shape of the cam member. For example, when the operation unit is in a position for performing a choking operation, an increase in the number of revolutions of the engine due to an increase in fuel consumption caused by the choking operation can be prevented by reducing the throttle opening relative to the choke-off state. In addition, a degree of freedom in setting a rate of change in the throttle opening with respect to an operation amount is also increased, and thus tuning of characteristics such as so-called early opening or late opening can be easily achieved.

A second aspect of the invention provides the operation device for an engine according the first aspect of the invention, wherein the operation device includes a choke drive member which operates a choke mechanism of the engine in cooperation with the link member when the link member is in a predetermined choke position, and the cam member has a cam shape which allows the throttle drive member to set a throttle opening to a predetermined throttle opening in a choke-on time when the link member is in the choke position. According to the above, when fuel consumption is increased due to a choking operation, an excessive increase in the number of revolutions of the engine can be prevented by setting the throttle opening so as to achieve a desired number of revolutions of the engine.

A third aspect of the invention provides the operation device for an engine according the first aspect or the second aspect of the invention, wherein the angular position of the cam member around the center of rotation with respect to the base is allowed to be changed, and the operation device has a fixing unit configured to fix relative positions of the cam member and the link member in a state where the throttle drive member opens a throttle to a maximum. According to the above, the maximum number of revolutions of the engine can be easily controlled by temporarily shifting a cam member integrally with a link member using a fixing unit.

BRIEF DESCRIPTION OF THE DRAWINGS

FIG. 5 is a diagram illustrating the positional relationship between the members in the operation device of FIG. 1 when the choke is on;

DESCRIPTION OF THE PREFERRED EMBODIMENTS

The present invention solves the problems posed by an operation device for an engine by performing a throttle operation with a cam mechanism driven by an operation wire, and setting a cam profile so as to reduce the throttle opening when the choke is on, the operation device being configured to increase the degree of freedom in setting the relationship between an operation amount of an operation unit and a throttle opening with a simple structure.

Embodiment

Hereinafter, an embodiment of an operation device to which the present invention is applied will be described. The operation device of the embodiment is installed, for example, in a mowing machine which uses what is called a V-shaft general-purpose engine as a power source, in which a crankshaft is arranged in the vertical direction. The type of an engine to which the operation device is applied, and the type of a machine to be driven by the engine are not necessarily the above types, and are not specifically limited. The operation device adopts a configuration which allows an operator to open and close a throttle, turn on and off a choke, and stop the engine by operating a single lever which is disposed apart from the engine. FIGS. 1 to 4 are external perspective views of the operation device of the embodiment. FIGS. 5 to 9 are diagrams illustrating the positional relationships between the members in the operation device of the embodiment in respective states of a choke-on state, a choke-off state, a high-load (high speed) state, an idle (low speed) state, and a stop state.

Figure 1:
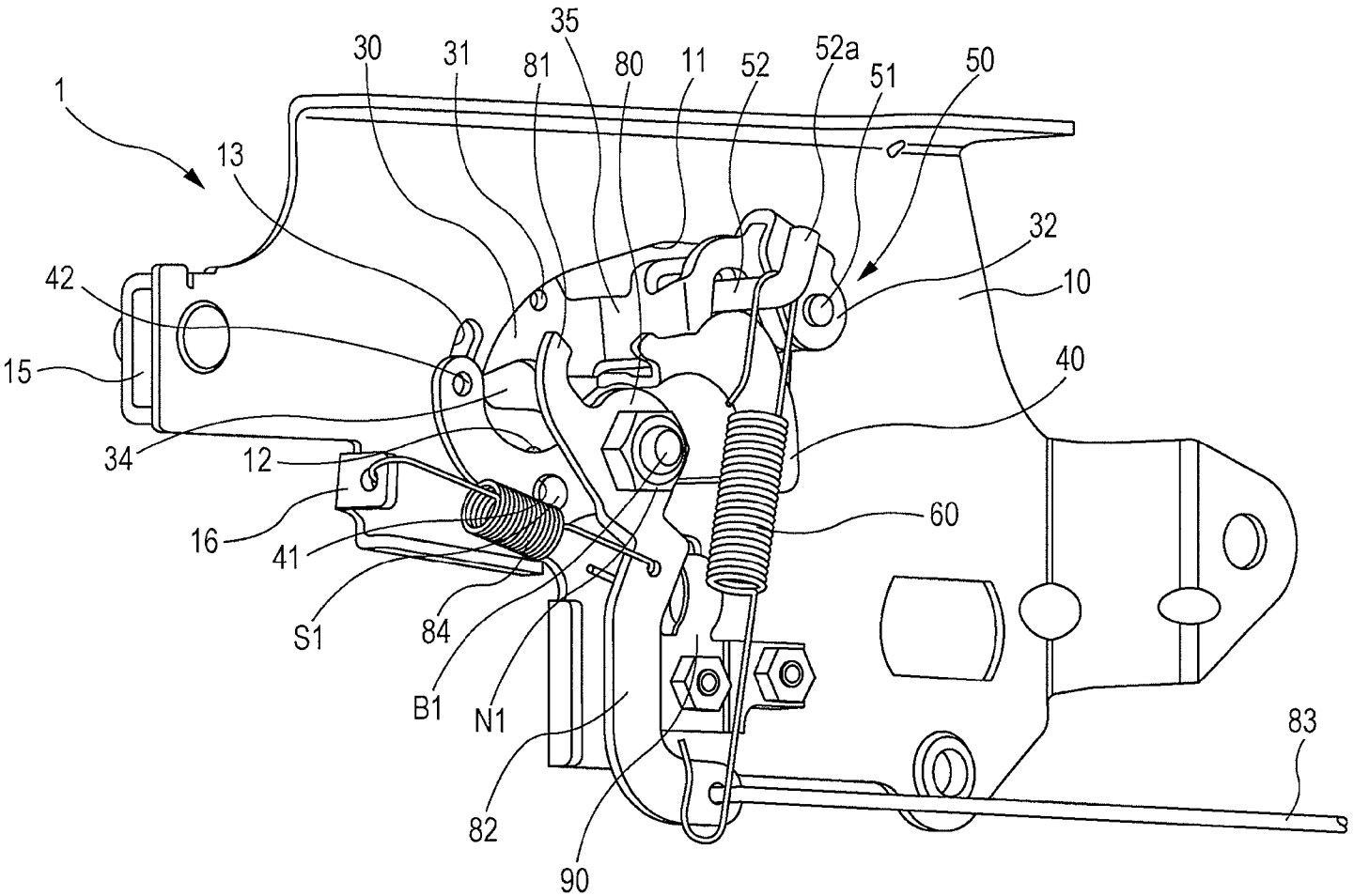
FIG. 1 is an external perspective view, seen from one of the sides, of an embodiment of an operation device to which the present invention is applied.
Figure 2:
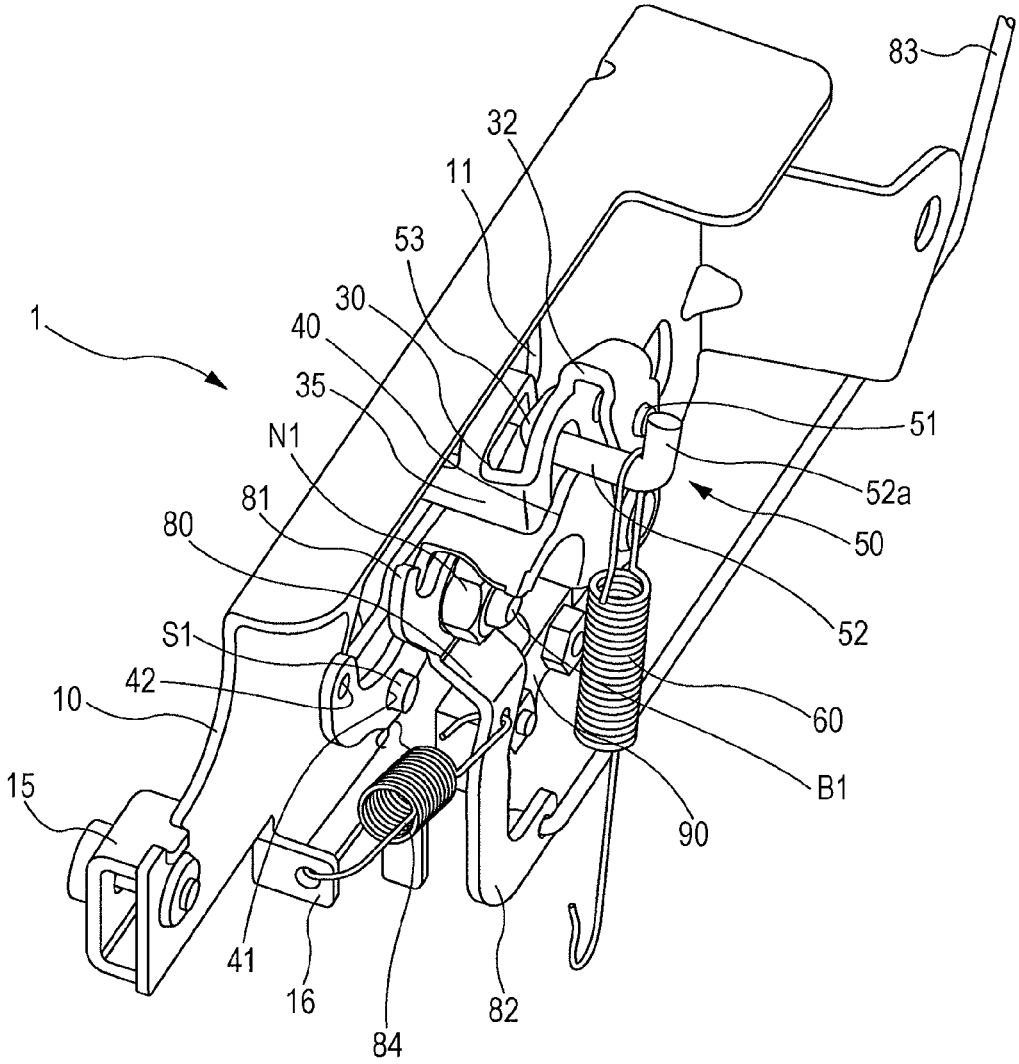
FIG. 2 is an external perspective view, seen from a position above the view point of FIG. 1, of the operation device of FIG. 1.
Figure 3:
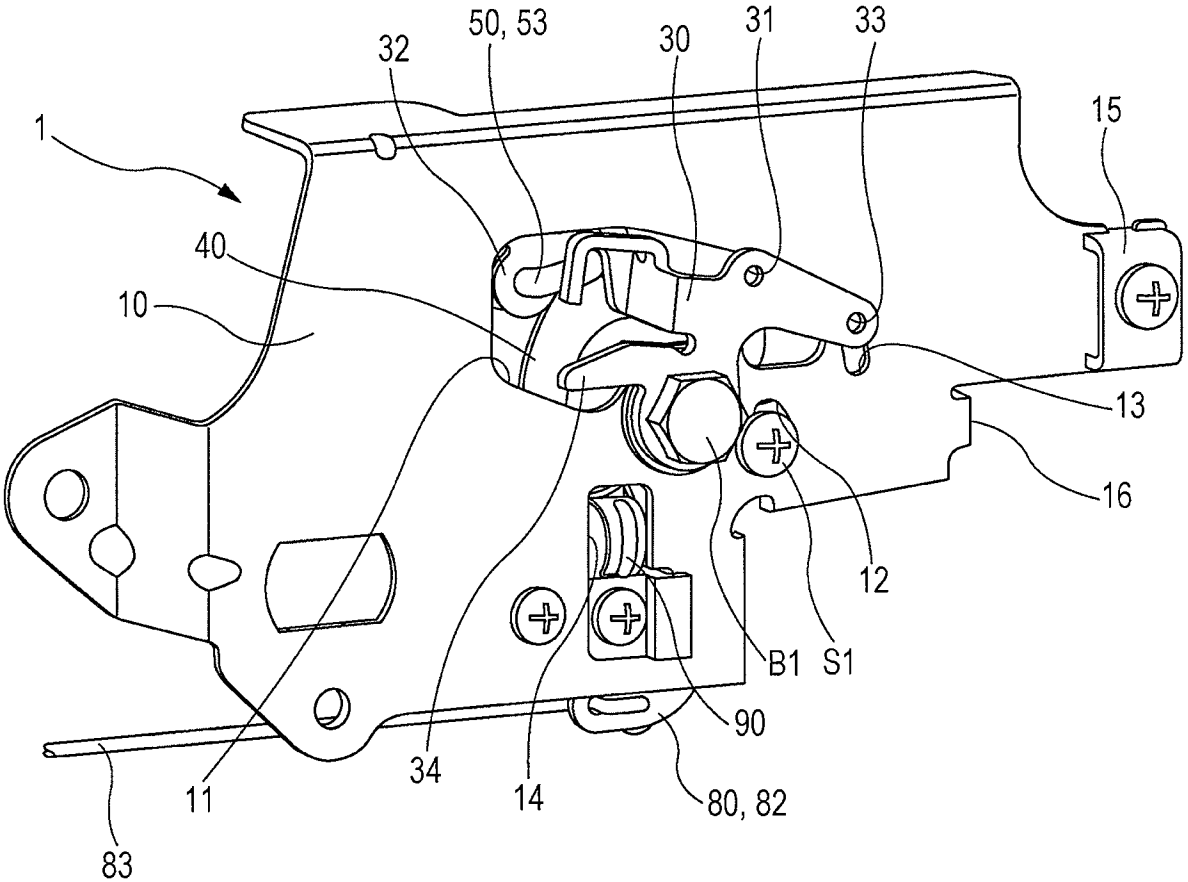
FIG. 3 is an external perspective view, seen from the side opposite to the side in FIG. 1, of the operation device of FIG. 1.
Figure 4:
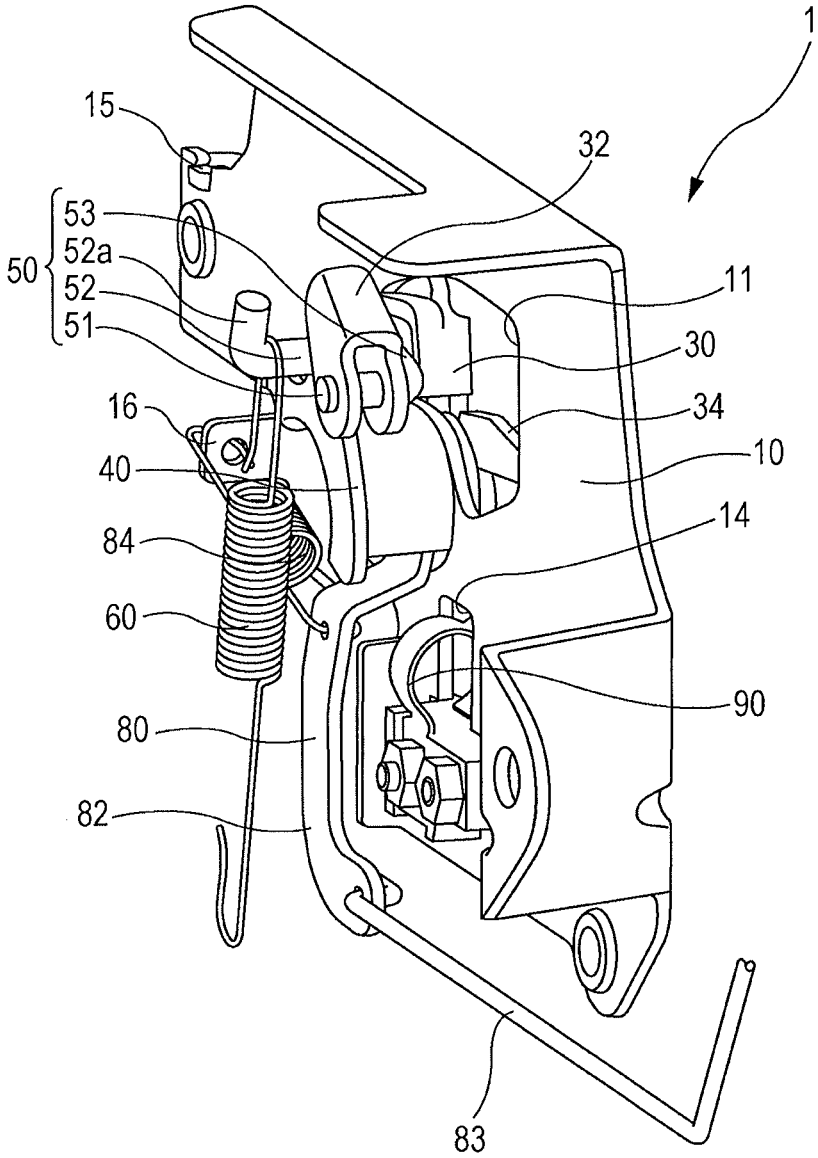
FIG. 4 is an external perspective view, seen from the side of a choke rod, of the operation device of FIG. 1.
Figure 5:
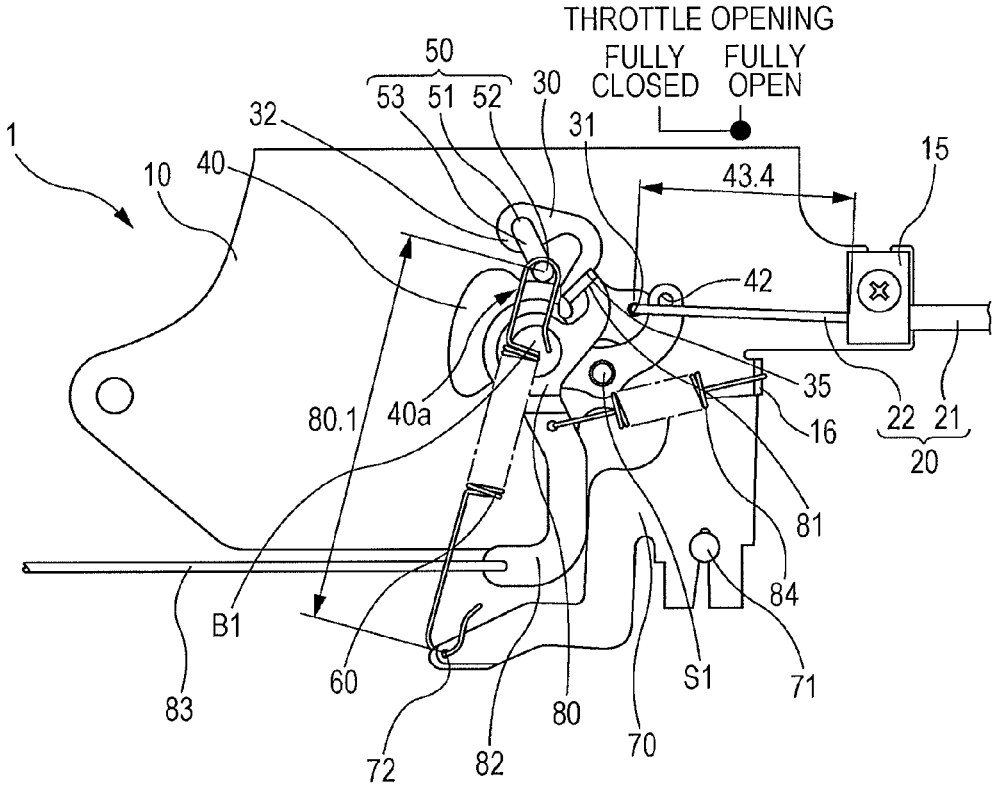
Figure 6:
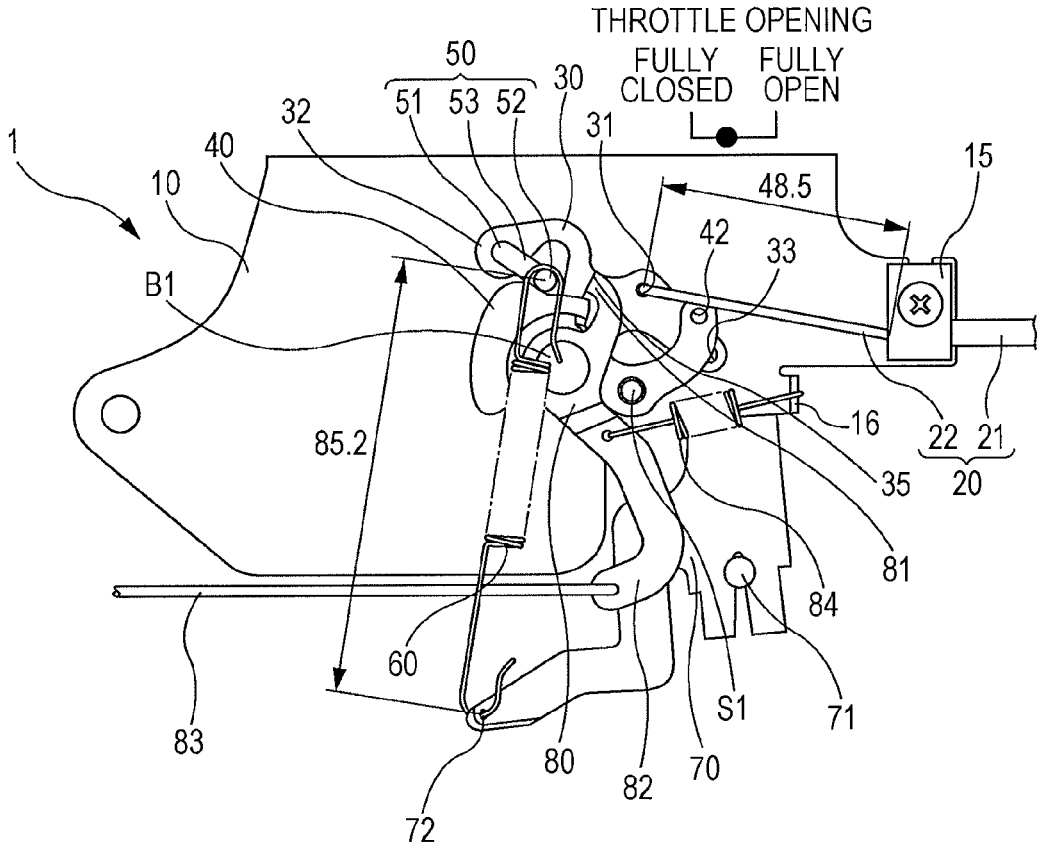
FIG. 6 is a diagram illustrating the positional relationship between the members in the operation device of FIG. 1 when the choke is off.
Figure 7:
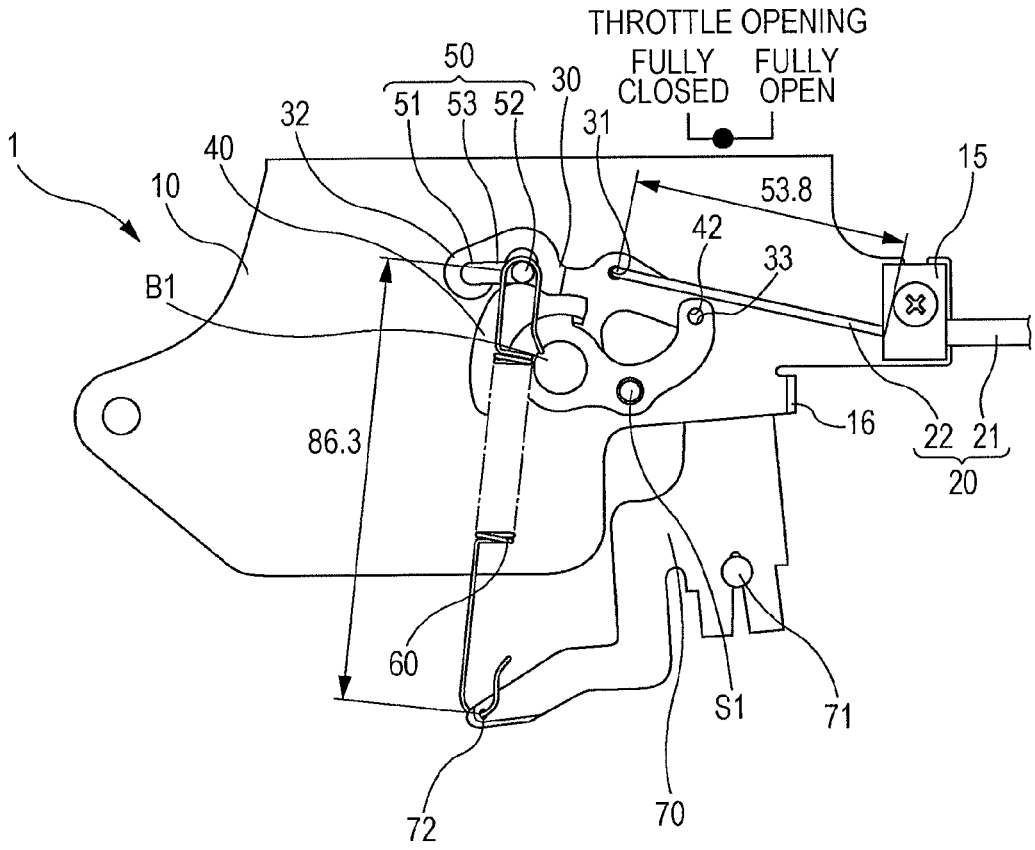
FIG. 7 is a diagram illustrating the positional relationship between the members in the operation device of FIG. 1 when the engine is in a high load (high speed)
Figure 8:
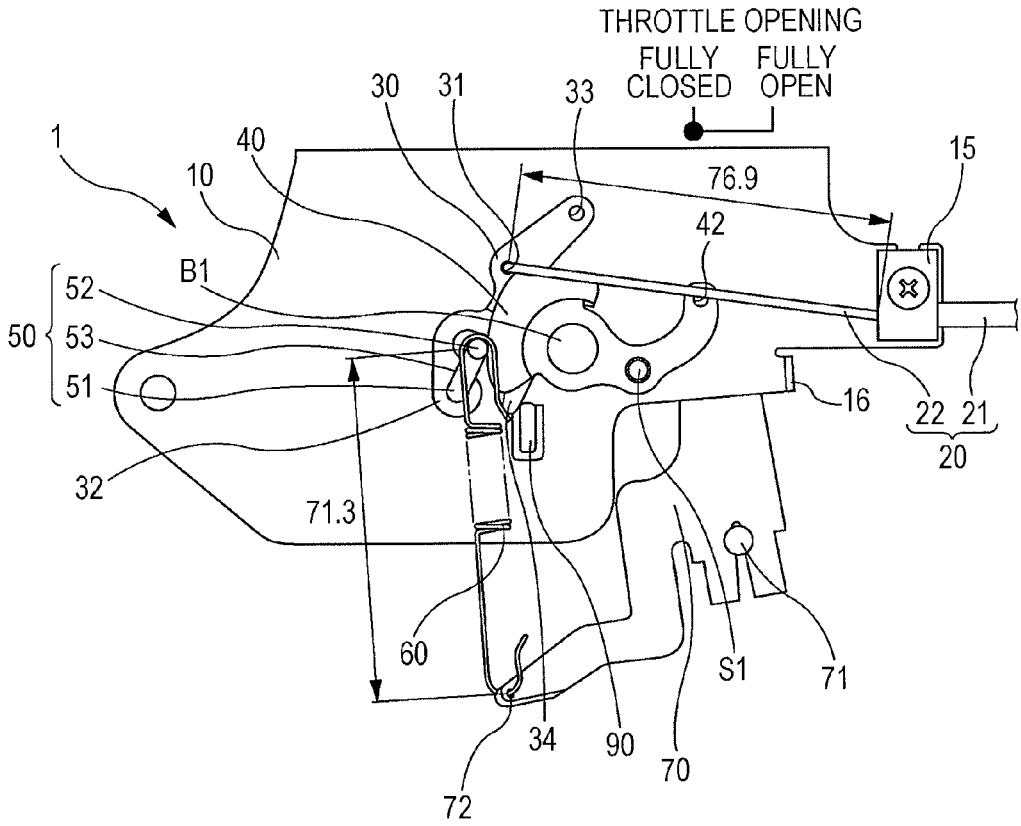
FIG. 8 is a diagram illustrating the positional relationship between the members in the operation device of FIG. 1 when the engine is idle (low speed)
Figure 9:
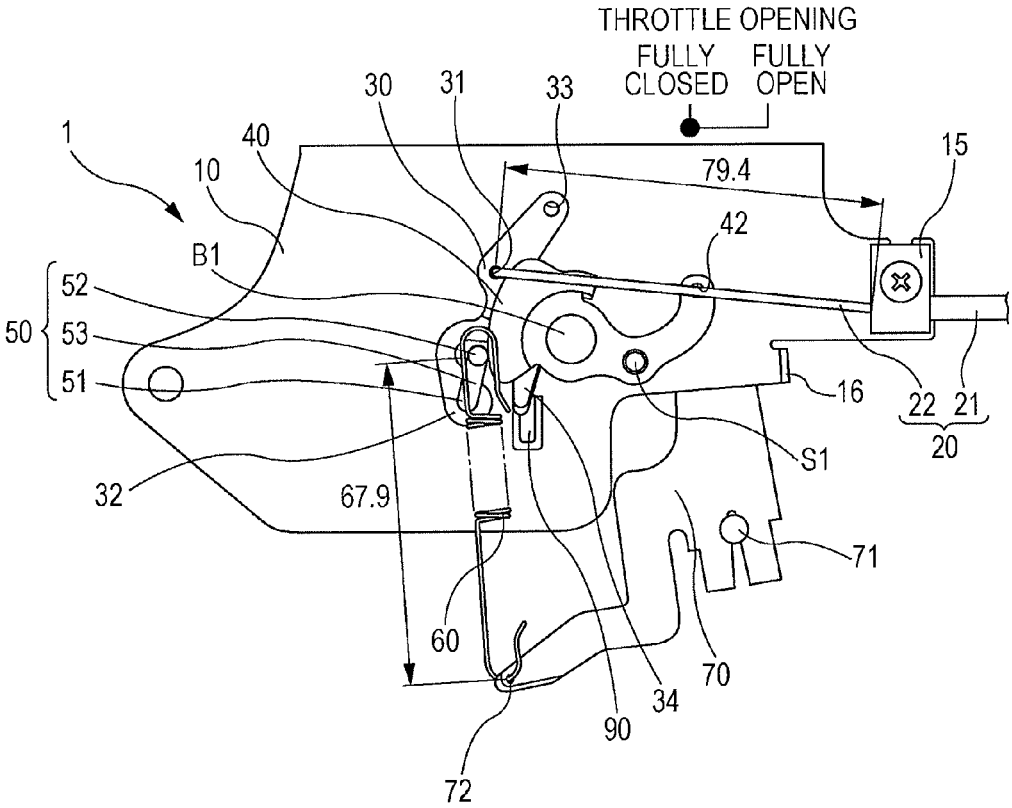
FIG. 9 is a diagram illustrating the positional relationship between the members in the operation device of FIG. 1 when the engine is stopped.

An operation device 1 includes a bracket 10, an operating wire 20, a link lever 30, a cam 40, a governor spring pin 50, a governor spring 60, a governor lever 70, a choke lever 80, and a stop switch 90 (the operating wire 20 and the governor lever 70 are not illustrated in FIGS. 1 to 4 (see FIGS. 5 to 9 for the operating wire 20 and the governor lever 70), the choke lever 80 is not illustrated in FIGS. 7 to 9, and the stop switch 90 is not illustrated in FIGS. 5 to 7.)

The bracket 10 is a base member to which the above-mentioned components are directly or indirectly attached. The bracket 10 is formed of, for example, a metal plate, and in the center of the bracket 10, there is formed an opening (not shown) into which a bolt B1 is inserted. The bolt B1 is a central shaft around which the link lever 30, the cam 40, and the choke lever 80 are concentrically rotated with respect to the bracket 10. The link lever 30, the cam 40, and the choke lever 80 are attached by the bolt B1 in cooperation with a nut N1 to the bracket 10 so as to be rotatable around the bracket 10. On the periphery of the opening for the bolt B1, there are formed a lever opening 11, a cam fixing screw opening 12, a rotation set pin opening 13, and a stop switch opening 14.

The lever opening 11 is an opening into which the below-described governor spring pin locking unit 32 of the link lever 30 is inserted. The lever opening 11 is formed in such a size that no interference occurs between the governor spring pin locking unit 32 and the bracket 10 when the link lever 30 is rotated. The cam fixing screw opening 12 is an opening into which a cam fixing screw S1 for fixing the cam 40 is inserted, and is formed as an arc-shaped oblong hole which is concentric with the bolt B1 so that the cam 40 can be fixed even when the angle of the cam 40 around the bolt B1 is adjusted. Both ends of the cam fixing screw opening 12 in the circumferential direction define an adjustable range of the cam 40. The rotation set pin opening 13 is an opening into which a rotation set pin is inserted when the position of the cam 40 is adjusted, the rotation set pin being configured to secure the relative angular positions of the link lever 30 and the cam 40 around the bolt B1 in a high-load (high speed) state. The rotation set pin opening 13 is formed as an arc-shaped oblong hole which is concentric with the bolt B1. The stop switch 90 for stopping the engine by grounding the ignition system of the engine is attached to the stop switch opening 14.

In addition, the bracket 10 is provided with a clamp 15 and a return spring hook 16. One end of an outer wire 21 of the operating wire 20 is fixed to the clamp 15. One end of the below-described return spring 84 of the choke lever 80 is hooked to the return spring hook 16.

The operating wire 20 transmits a movement of an operation lever (not shown) to the link lever 30, the operation lever being used by an operator who operates the engine. The operating wire 20 is a push-pull wire which is formed by inserting an inner wire 22 inside the tube-shaped outer wire 21. The end of the outer wire 21 on the side of the link lever 30 is fixed to the clamp 15 of the bracket 10. The end of the inner wire 22 on the side of the link lever 30 is connected to the below-described wire connector 31 of the link lever 30. The inner wire 22 is drawn out from or pushed into the outer wire 21 in relation to a movement of the operation lever.

The link lever 30 is a member which is driven by the inner wire 22, and is rotatable with respect to the bracket 10 around the central shaft of the bolt B1. The link lever 30 includes the wire connector 31, the governor spring pin locking unit 32, the rotation set pin opening 33, a stop switch contact projection 34, and a choke lever interlocking unit 35.

One end of the inner wire 22 of the operating wire 20 is connected to the wire connector 31. The link lever 30 is rotated around the bolt B1 by the inner wire 22 pushing or pulling the wire connector 31. A rotation shaft 51 of the below-described governor spring pin 50 is inserted to the governor spring pin locking unit 32. The governor spring pin locking unit 32 is configured to support the rotation shaft 51 at two points that are separated in the axis direction (in the thickness direction of the main body of the bracket 10 and the link lever 30) by bending one end of the link lever 30. The rotation set pin opening 33 is an opening into which a rotation set pin is inserted, the rotation set pin being used when the position of the cam 40 is adjusted. A terminal of the stop switch 90 comes into contact with the stop switch contact projection 34 when the link lever 30 is rotated to reach a position for stopping the engine. The choke lever interlocking unit 35 presses and rotates the choke lever 80 to cause the choke to operate.

The cam 40 includes a cam crest surface which is disposed on the inner radius side (the side near the bolt B1) of the governor spring pin locking unit 32 of the link lever 30 with respect to the central shaft of the bolt B1. The cam crest surface is formed such that the distance from the central shaft changes continuously in accordance with the angular position of the cam crest surface around the central shaft of the bolt B1. The cam crest surface is configured to guide the below-described cam follower 52 of the governor spring pin 50. In addition, the position of the cam 40 can be adjusted in the direction of rotation with respect to the bracket 10 around the bolt B1 when the maximum number of revolutions of the engine is controlled. The cam 40 is provided with a fixing screw opening 41 into which the cam fixing screw S1 used for fixing to the bracket 10 is inserted, and a rotation set pin opening 42 into which the rotation set pin is inserted.

The governor spring pin 50 is swingably connected to the link lever 30, and has the cam follower 52 which is guided to the cam crest surface of the cam 40, and further pulls the governor spring 60 connected to the cam follower 52. The governor spring pin 50 includes the rotation shaft 51, the cam follower 52, and a coupler 53. These are integrally formed by bending, for example, a round bar material.

The rotation shaft member 51 is inserted into and locked in the governor spring pin locking unit 32 of the link lever 30, and is rotatably supported. The rotation shaft member 51 is disposed in parallel with the bolt B1. The cam follower 52 is disposed in parallel with the rotation shaft member 51 at a predetermined interval. The outer peripheral surface of the cam follower 52 is guided along the cam crest surface of the cam 40 in relation to the rotation of the link lever 30 with respect to the bracket 10 around the bolt B1. In the above, the governor spring pin 50 swings around the rotation shaft member 51 with respect to the governor spring pin locking unit 32 of the link lever 30 in accordance with a change in the distance between the cam follower 52 and the bolt B1. At one end (the end opposite to the coupler 53) of the cam follower 52, there is formed a hook 52*a* which is bent in a hook-shaped manner in order to hook one end of the governor spring 60. The coupler 53 is disposed between the ends of the rotation shaft member 51 and the cam follower 52 in order to connect the former to the latter.

The governor spring 60 is a helical extension spring which is provided between the cam follower 52 (the hook 52*a*) of the governor spring pin 50, and the governor lever 70. The governor spring 60 is a throttle drive member which urges the governor lever 70 in the direction for opening an engine throttle when being pulled.

The governor lever 70 is a member which couples the governor spring 60 to an engine governor mechanism (not shown), and drives the engine throttle. As illustrated in FIGS. 5 to 9, the governor lever 70 is made rotatable around a rotation shaft 71, and is provided with a governor spring locking unit 72 at which one end of the governor spring 60 is locked.

The choke lever 80 is a member which operates a choke mechanism of the engine, and is rotatable with respect to the bracket 10 around the bolt B1. The choke lever 80 includes an operating projection 81, a lever body 82, a choke rod 83, and the return spring 84. When the link lever 30 is rotated from a choke-off position to a choke-on position, the operating projection 81 is pressed by the choke lever interlocking unit 35 of the link lever 30 so as to cause the choke lever 80 to rotate in the same direction as the link lever 30 rotates. The lever body 82 has an arm shape and extends to the outer radius with respect to the bolt B1. The choke rod 83 is a transmission shaft which locks at one end in an opening provided in the distal end of the lever body 82, and transmits a movement of the lever body 82 to the choke mechanism (not shown) of the engine so as to operate the engine. The return spring 84 is a helical extension spring having two ends which are locked in an intermediate portion of the lever body 82 and the return spring hook 16 of the bracket 10, respectively. The return spring 84 causes the choke lever 80 to rotate in a choke-off direction when the operating projection 81 is not urged against the choke lever interlocking unit 35 of the link lever 30.

The stop switch 90 electrically grounds the ignition system of the engine to stop the engine by coming into contact with the stop switch contact projection 34 of the link lever 30.

Next, the operation of the above-described operation device 1 will be explained. Hereinafter, a choke-on state, a choke-off state, a high-load (high speed) state, an idle (low speed) state, and a stop state which are illustrated in FIGS. 5 to 9 are described one by one. A shift between these states is achieved by drawing out the inner wire 22 of the operating wire 20 so as to successively rotate the link lever 30 in the counterclockwise direction in FIGS. 5 to 9.

<Choke on State>

The choke-on state illustrated in FIG. 5 is a state to which the choke is set during cold start of the engine, and in the choke-on state, a choking operation is performed on the engine while the throttle opening is reduced by a predetermined amount relative to a full open position so that an excessive increase in the number of revolutions of the engine due to an increase in fuel consumption caused by the choking operation can be prevented. Such a closing operation of the throttle can be achieved by forming a forced revolution reduction position during choke operation 40*a* at which a trough-shaped depression is formed on the cam surface of the cam 40. The choke lever interlocking unit 35 of the link lever 30 pushes the operating projection 81 of the choke lever 80 to cause the choke lever 80 to rotate so as to make the choke mechanism of the engine perform a choking operation via the choke rod 83. In the choke-on state, the drawn out length of the inner wire 22 from the clamp 15 to the wire connector 31 of the link lever 30 is, for example, 43.4 mm, and the set length of the governor spring 60 from the cam follower 52 of the governor spring pin 50 to the governor spring locking unit 72 of the governor lever 70 is, for example, 80.1 mm.

<Choke Off State>

The choke-off state illustrated in FIG. 6 is a state to which the choke is set when a choke-on state is terminated, and in the choke-off state, a choking operation of the engine is terminated and the throttle is in an open (high speed) state relative to the choke-on state. Such an opening operation of the throttle can be achieved by the cam follower 52 leaving the forced revolution reduction position during choke operation 40*a* of the cam 40 and moving up the cam crest. The choke lever interlocking unit 35 of the link lever 30 which is in contact with the operating projection 81 of the choke lever 80, however, does not press against the operating projection 81 practically, and the choke lever 80 is substantially rotated to the choke-off position by the urging force of the return spring 84. In the choke-off state, the drawn out length of the inner wire 22 is, for example, 48.5 mm, and the set length of the governor spring 60 is, for example, 85.2 mm.

<High-Load (High Speed) State>

The high-load state illustrated in FIG. 7 is a state to which the engine is set when an engine-driven device such as a mowing machine is operated with a high load, and in the high-load state, a choking operation of the engine is not performed and the throttle is opened to a position at which the maximum number of revolutions of the engine can be achieved. In the above state, the cam follower 52 further moves up the cam crest relative to the choke-off state, and comes into contact with the top of the cam crest (cam crest highest position) at which the surface of the cam crest is the furthest from the central shaft of the bolt B1. In the high-load state, the drawn out length of the inner wire 22 is, for example, 53.8 mm, and the set length of the governor spring 60 is, for example, 86.3 mm.

<Idle (Low Speed) State>

The idle state illustrated in FIG. 8 is a state to which the engine is set during a standby time or the like of an engine-driven device, and in the idle state, a choking operation of the engine is not performed and the throttle is closed to a position for achieving the minimum number of revolutions (idling revolution) of the engine. In the above state, the cam follower 52 moves down from the top of the cam crest relative to the high-load state. In the idle state, the drawn out length of the inner wire 22 is, for example, 76.9 mm, and the set length of the governor spring 60 is, for example, the free length of the governor spring 60, which is 71.3 mm. In the operation device 1, the number of revolutions of the engine can be adjusted steplessly between the high-load state and the idle state by rotating the link lever 30.

<Stop State>

The stop state illustrated in FIG. 9 is a state to which the engine is set when it is stopped, and in the stop state, the throttle opening is substantially the same as that of the idle state. The stop switch contact projection 34 of the link lever 30 halts the ignition of the engine to stop the engine by coming into contact with the terminal of the stop switch 90. In the stop state, the drawn out length of the inner wire 22 is, for example, 79.4 mm, and the set length of the governor spring 60 falls below the free length thereof, and is, for example, 67.9 mm, and the governor spring 60 is loosened.

For example, during an acceptance operation or the like, the operation device 1 can arbitrarily adjust the maximum number of revolutions of the engine by shifting the angular position of the cam 40 around the bolt B1. Adjustment of the cam 40 is performed in the high-load state illustrated in FIG. 7. In the above step, the rotation set pin opening 33 of the link lever 30, and the rotation set pin opening 42 of the cam 40 are disposed in an overlapping position in the shaft direction of the bolt B1. First, rotation set pins (not shown) are inserted into the rotation set pin openings 33, 42 so as to control relative rotation of the rotation set pin openings around the bolt B1. Next, the cam fixing screw S1 is loosened so as to rotate both the link lever 30 and the cam 40 relative to the bracket 10. Accordingly, the set length of the governor spring 60 is changed, and the number of revolutions of the engine is changed. The cam fixing screw S1 is then fastened again at a position where a desired number of revolutions of the engine is achieved so as to fix the cam 40 relative to the bracket 10. The rotation set pins are then removed and adjustment of the maximum number of revolutions is completed. After the adjustment, the number of revolutions of the engine is set to the maximum number of revolutions or less regardless of the position of the link lever 30.

According to the embodiment described above, by adopting a configuration in which the cam follower 52 which is driven along the cam crest surface of the cam 40 by the operating wire 20 pulls the governor spring 60 as a throttle operating member, the degree of freedom in setting the relationship between the drawn out amount of the inner wire 22 and the throttle opening (engine revolution) can be increased with a simple structure in which each member is rotated around a single shaft. With this approach, the throttle opening and the rate of change in the engine revolution with respect to an operation amount of the operation unit can be set in a relatively free manner. For example, tuning of characteristics such as so-called early opening or late opening of the throttle can be achieved easily, and thus the operability can be improved. The throttle opening in a choke-on state can be set with a reduced throttle opening so as to suppresses an increase in the number of revolutions regardless of an increase in fuel consumption, and thus an excessive increase in the number of revolutions of the engine due to an increase in fuel consumption caused by a choking operation can be prevented.

(Modification)

The present invention is not limited to the embodiment described above, and may be modified or changed in various manners. The modified or changed embodiments are also included in the scope of the present invention.

(1) The structure, shape, arrangement, and the like of each member constituting the operation device is not limited to the above-described embodiment, and may be changed as needed. For example, the shape of the cam in the embodiment is just an example, and may be modified as needed according to a design objective. In the case where wear or the like of the cam follower poses a problem, the cam follower may be a roller follower having a roller-shaped rolling element. Mechanical elements such as various wires, rods, and bolts may be changed as needed to other mechanical elements having substantially the same functions as those of the above mechanical elements.

(2) The devices to which the operation device is applied are, for example, a mowing machine, a bush cutter, and the like, and on top of that, may be any device, vehicle, or the like in which an operation unit is disposed apart from the engine body.

What is claimed is:

1. An operation device for an engine, for performing a throttle operation of the engine which is disposed apart from an operation unit operated by an operator, the operation device comprising:

a link member rotatable with respect to a base in response to an operation of the operation unit;

a cam member fixed to the base and having a cam surface, a distance from a center of rotation of the link member to the cam surface changing continuously along a length of the cam surface according to an angular position of the cam member around the center of rotation;

a cam follower connected to the link member and configured to contact and move along the cam surface; and a throttle drive member for connecting the cam follower to a throttle operation unit of the engine, wherein the operation device includes a choke drive member for operating a choke mechanism of the engine in cooperation with the link member when the link member is in a predetermined choke position, and the cam member has a cam shape to allow the throttle drive member to set a throttle opening to a predetermined throttle opening in a choke-on state when the link member is in the choke position.

2. An operation device for an engine for performing a throttle operation of the engine which is disposed apart from an operation unit operated by an operator, the operation device comprising:

a link member rotatable with respect to a base in response to an operation of the operation unit;

a cam member fixed to the base and having a cam surface, a distance from a center of rotation of the link member to the cam surface changing continuously along a length of the cam surface according to an angular position of the cam member around the center of rotation;

a cam follower connected to the link member and configured to contact and move along the cam surface; and a throttle drive member for connecting the cam follower to a throttle operation unit of the engine, wherein the angular position of the cam member around the center of rotation with respect to the base is adjustable, and the operation device has a fixing unit to fix relative angular positions of the cam member and the base in a state where the throttle drive member opens a throttle to a maximum.

3. The operation device for an engine according to claim 1, wherein the angular position of the cam member around the center of rotation with respect to the base is adjustable, and the operation device has a fixing unit to fix relative angular positions of the cam member and the base in a state where the throttle drive member opens a throttle to a maximum

4. The operation device for an engine according to claim 1, wherein the cam member is adjustable between multiple fixed angular positions.

5. The operation device for an engine according to claim 1, wherein the throttle drive member comprises a spring member.

6. The operation device for an engine according to claim 1, wherein the throttle drive member is a variable length member.

7. The operation device for an engine according to claim 6, wherein the cam member is adjustable between multiple fixed angular positions, and a length of the throttle drive member is adjustable based on an adjustment of the cam member between fixed angular positions.

8. An operation device for an engine for performing a throttle operation of the engine which is disposed apart from an operation unit operated by an operator, the operation device comprising:

a link member rotatable with respect to a base in response to an operation of the operation unit;

a cam member fixed to the base and having a cam surface, a distance from a center of rotation of the link member to the cam surface changing continuously along a length of the cam surface according to an angular position of the cam member around the center of rotation;

a cam follower connected to the link member and configured to contact and move along the cam surface;

a throttle drive member for connecting the cam follower to a throttle operation unit of the engine;

a first fixing reception in the cam member;

a second fixing reception in the base; and a fixing unit configured for simultaneous reception in both the first and second fixing receptions, wherein the cam member is adjustable between multiple fixed angular positions when the fixing unit is not securely received in both the first and second fixing receptions, the first and second fixing receptions are configured to receive the fixing unit with the cam member oriented at the multiple fixed angular positions, and the fixing unit, when secured in both the first and second fixing receptions, fixes the cam member to the base in a fixed angular position.

9. The operation device for an engine according to claim 1, wherein a distance from the center of rotation to the cam follower changes continuously as the cam follower moves along the continuously changing length of the cam surface, and the continuously changing length of the cam surface comprises a depression and a crest.

10. The operation device for an engine according to claim 2, wherein the cam member is adjustable between multiple fixed angular positions.

11. The operation device for an engine according to claim 2, wherein the throttle drive member comprises a spring member.

12. The operation device for an engine according to claim 2, wherein the throttle drive member is a variable length member.

13. The operation device for an engine according to claim 12, wherein the cam member is adjustable between multiple fixed angular positions, and a length of the throttle drive member is adjustable based on an adjustment of the cam member between fixed angular positions.

14. The operation device for an engine according to claim 8, wherein the cam member is adjustable between multiple fixed angular positions.

15. The operation device for an engine according to claim 8, wherein the throttle drive member comprises a spring member.

16. The operation device for an engine according to claim 8, wherein the throttle drive member is a variable length member.

17. The operation device for an engine according to claim 16, wherein the cam member is adjustable between multiple fixed angular positions, and a length of the throttle drive member is adjustable based on an adjustment of the cam member between fixed angular positions.

18. The operation device for an engine according to claim 2, wherein a distance from the center of rotation to the cam follower changes continuously as the cam follower moves along the continuously changing length of the cam surface, and the continuously changing length of the cam surface comprises a depression and a crest.

19. The operation device for an engine according to claim 8, wherein a distance from the center of rotation to the cam follower changes continuously as the cam follower moves along the continuously changing length of the cam surface, and the continuously changing length of the cam surface comprises a depression and a crest.

* * * * *